US010472918B2

(12) United States Patent
Fripp et al.

(10) Patent No.: US 10,472,918 B2
(45) Date of Patent: Nov. 12, 2019

(54) DEGRADABLE ISOLATION DEVICES WITH EMBEDDED TRACERS

(71) Applicant: Halliburton Energy Services, Inc., Houston, TX (US)

(72) Inventors: Michael Linley Fripp, Carrollton, TX (US); John Todd Broome, Highlands Ranch, CO (US); Zachary William Walton, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/754,263

(22) PCT Filed: Oct. 28, 2015

(86) PCT No.: PCT/US2015/057866

§ 371 (c)(1),
(2) Date: Feb. 21, 2018

(87) PCT Pub. No.: WO2017/074364

PCT Pub. Date: May 4, 2017

(65) Prior Publication Data

US 2018/0252067 A1 Sep. 6, 2018

(51) Int. Cl.

| | |
|---|---|
| ***E21B 33/12*** | (2006.01) |
| ***E21B 43/26*** | (2006.01) |
| ***E21B 47/10*** | (2012.01) |

(52) U.S. Cl.

CPC ..... *E21B 33/1208* (2013.01); *E21B 33/12* (2013.01); *E21B 43/26* (2013.01); *E21B 47/1015* (2013.01)

(58) Field of Classification Search

CPC ..... E21B 33/1208; E21B 21/003; E21B 2033/105; E21B 33/10; E21B 33/13; E21B 33/134; E21B 33/16; E21B 33/12

See application file for complete search history.

(56) References Cited

U.S. PATENT DOCUMENTS

| | | | |
|---|---|---|---|
| 7,455,108 | B2 | 11/2008 | Jenkins et al. |
| 8,230,731 | B2 | 7/2012 | Dyer et al. |

(Continued)

FOREIGN PATENT DOCUMENTS

| | | |
|---|---|---|
| CA | 2868885 C | 11/2017 |
| WO | 2013187943 | 12/2013 |

(Continued)

OTHER PUBLICATIONS

Hwang, Suk-Won, et al. "A physically transient form of silicon electronics." Science 337.6102 (2012): 1640-1644.

(Continued)

*Primary Examiner* — Zakiya W Bates

(74) *Attorney, Agent, or Firm* — McGuireWoods LLP

(57) ABSTRACT

The disclosed embodiments include a wellbore isolation device, a method to form the wellbore isolation device, and a downhole, device-tracking system. In one embodiment, the system includes a wellbore isolation device having a first identification tag and a dissolvable component. The first identification tag is operable to travel along a fluid flow path toward the surface of a well upon dissolution of the dissolvable component. The system also includes a detector disposed along the fluid flow path, where the detector is operable to detect the first identification tag when the first identification tag is proximate to the detector.

19 Claims, 5 Drawing Sheets

(56) References Cited

U.S. PATENT DOCUMENTS

| | | | | |
|---|---|---|---|---|
| 9,033,041 | B2 | 5/2015 | Baihly et al. | |
| 2005/0205264 | A1 | 9/2005 | Starr et al. | |
| 2011/0277544 | A1* | 11/2011 | Rytlewski | E21B 47/1015 73/152.18 |
| 2012/0227962 | A1 | 9/2012 | Richard | |
| 2014/0166266 | A1 | 6/2014 | Read | |

FOREIGN PATENT DOCUMENTS

| | | | |
|---|---|---|---|
| WO | 2015069297 | A1 | 5/2015 |
| WO | 2015094449 | | 6/2015 |

OTHER PUBLICATIONS

International Search Report and Written Opinion dated Jul. 20, 2016; International PCT Application No. PCT/US2015/057866.
Canadian Office Action dated Dec. 4, 2018; Canadian Patent Application No. 2,995,682.

* cited by examiner

DEGRADABLE ISOLATION DEVICES WITH EMBEDDED TRACERS

FIELD

The present disclosure relates generally to wellbore isolation devices and methods to manufacture thereof.

BACKGROUND

Hydraulic fracturing is a technique often used to access resource deposits such as hydrocarbon deposits and other types of resources trapped in a rock formation, such as a shale formation. Hydraulic fracturing is often combined with horizontal drilling to reduce the surface disturbance of the drilling operation, and also to reach multiple hydrocarbon deposits spread across vast areas.

Horizontal drilling techniques for forming a wellbore often include vertically drilling from a surface location to a desired subterranean depth, from which point, drilling is curved or at a sub-terrain plane approximately horizontal to the surface to connect the wellbore to multiple hydrocarbon deposits. Once the wellbore and support structures have been formed, a perforating gun is lowered down the wellbore and is detonated at multiple locations of the wellbore to generate explosions into the wellbore to create a plurality of perforations along rock formations surrounding the wellbore. A fracking fluid is pumped into the wellbore to create and to augment fractures in the rock formations surrounding the perforations. The fracking fluid may also include particles that help to preserve the structural integrity of the perforations and surrounding fractures during operation of the well.

BRIEF DESCRIPTION OF THE DRAWINGS

Illustrative embodiments of the present disclosure are described in detail below with reference to the attached drawing figures, which are incorporated by reference herein, and wherein.

The illustrated figures are only exemplary and are not intended to assert or imply any limitation with regard to the environment, architecture, design, or process in which different embodiments may be implemented.

DETAILED DESCRIPTION

The present disclosure relates to a wellbore isolation device, a method to manufacture the wellbore isolation device, and a downhole, device-tracking system. More particularly, this disclosure relates to a wellbore isolation device having a dissolvable portion and at least one identification tag, where the at least one identification tag is releasable from the wellbore isolation device upon dissolution of the dissolvable portion.

A wellbore may be divided into one or more zones or regions of interest. In hydraulic fracking operations, a perforation gun is detonated to generate explosions into the formation surrounding a zone to create perforations. A wellbore fluid is then pumped into the perforations to create and/or to enlarge fractures within the surrounding formations. The wellbore may be further prepared for production by packing the fractures with gravel to prevent collapse of the fractures, and to facilitate the flow of hydrocarbon resources into the wellbore.

In the course of fracking operations, a wellbore isolation device such as a frac plug may be disposed at a zone boundary of a zone of the wellbore to isolate the zone from other, adjacent zones and/or from other portions of the wellbore during the foregoing process to release the hydrocarbon resources. This sealing, or isolation of a zone enables the zone to be pressurized with fluid without affecting adjacent zones. Frac plugs may be composed of a variety of materials, including materials that are partially or completely dissolvable when exposed to a solvent fluid, which may be a wellbore fluid, negating the need to mill out or otherwise execute an extraction operation to remove to frac plug from the wellbore so that wellbore completion operations may resume. Examples of dissolvable materials include, but are not limited to, magnesium alloys, aluminum alloys, polyglycolic acid (PGA), a polylatic acid (PLA), thiol, and polyurethane.

In accordance with the illustrative embodiments of the present disclosure, an identification tag is disposed within the frac plug to facilitate identification of the frac plug and verify that it has dissolved. The identification tag may include a radio-frequency identification (RFID) chip, a near field communication transmitter, a chemical tracer, or a similar component that is suitable for identifying the frac plug. The identification tag, upon dissolution of at least a portion of the frac plug, is carried by wellbore fluid towards the surface, where the identification tag is detected. The tag may be detected by an in-line detector that monitors fluid flow from the well. The tag may also be collected in a collection basket at or near the surface and detected in a subsequent analysis of the contents of the collection basket.

Figure 1:
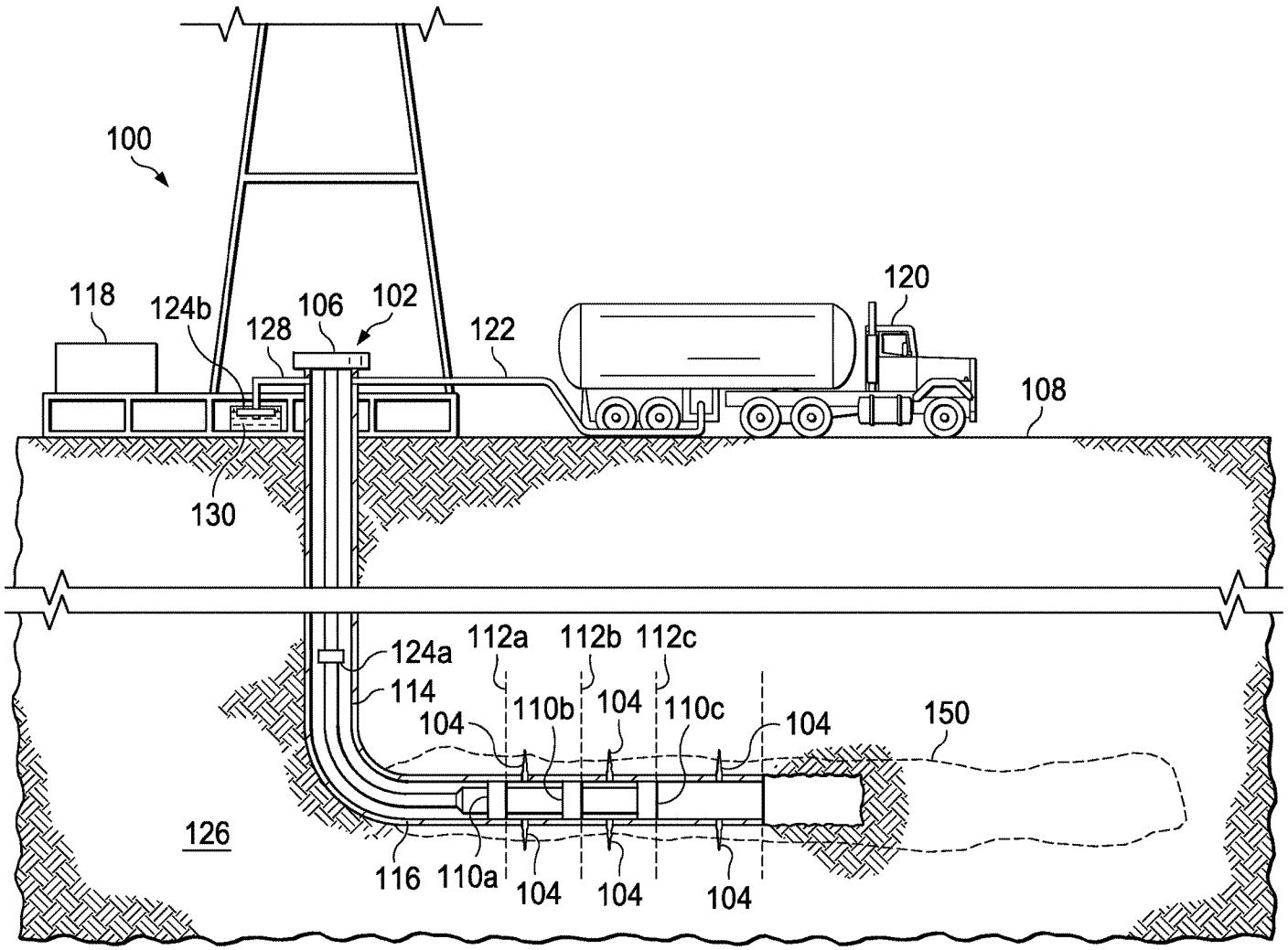
FIG. 1 is a schematic, side view of a hydraulic fracking environment that includes a wellbore and multiple wellbore isolation devices disposed at zone boundaries of a wellbore.

Turning now to the figures, FIG. 1 is a schematic, side view of a hydraulic fracking environment 100 that includes multiple wellbore isolation devices 110*a*, 110*b*, and 110*c*, which are respectively positioned at zone boundaries of zones 112*a*, 112*b*, and 112*c* of a wellbore 114. As shown in FIG. 1, the wellbore 114 extends from surface 108 of well 102, through formation 126, to target region 150. The target region 150 includes the first zone 112*a*, second zone 112*b*, and third zone 112*c*, and may be formed to include additional zones or fewer zones. A tool string 116 is deployed within the wellbore 114. The tool string 116 is operable to supply pressurized fluid to each of the first zone 112*a*, the second zone 112*b*, and the third zone 112*c* to expand perforations 104 at each respective zone.

At the wellhead 106, an inlet conduit 122 is coupled to the fluid source 120 to provide a pressurized wellbore fluid to the well 102. For example, the pressurized wellbore fluid may be pumped through the inlet conduit 122, down the wellbore 114 and into the third zone 112*c* to "frac" or fracture the perforations 104 of the zone. Following the fracking operation, the wellbore isolation device 110*c* is deployed proximate to the boundary of the third zone 112*c* to seal and isolate the third zone 112*c* from other portions of the wellbore 114. The process is then repeated for the second zone 112*b* and subsequently the first zone 112*a*, using wellbore isolation devices 110*b* and 110*a*, respectively to isolate the second zone 112*b* and first zone 112*a*.

Subsequently, fluid may be circulated into the well through the tool string 116 and back toward the surface 108 through an annulus between the outer wall of the tool string 116 and the wall of the wellbore to continue completion efforts. To that end, a diverter or outlet conduit 128 may be connected to a container 130 at the wellhead 106 to provide a fluid return flow path from the wellbore. The wellbore isolation devices 110*a*, 110*b*, and 110*c* may be configured to dissolve upon prolonged exposure to wellbore fluids, including upon exposure to certain solvents that may be included in the wellbore fluid. In such embodiments, the components of the isolation device may be water-soluble, oil-soluble, or soluble in the presence of other solvent fluids, such as, but not limited to alcohol based fluids, acetone based fluids, and propanediol based fluids.

When fluid is circulated in the well, the return fluid flow path carries debris and particulate from the wellbore, including remnants of dissolved wellbore isolations devices, following dissolution. Such remnants may include insoluble parts, such as identification tags, that may be carried by the pressurized wellbore fluid along the fluid return flow path where they are collected in the container 130. In an embodiment, inline detector 124*a* and collection container detector 124*b* are placed downhole and at the surface 108, respectively, to detect identification tags of the wellbore isolation device as they pass by the detectors 124*a* and 124*b*. Operations of the well 102 may be monitored by controllers 118 at the surface 108.

In some embodiments, the wellbore isolation devices 110*a*, 110*b*, and 110*c* are frac plugs. In other embodiments, the wellbore isolation device is a frac ball, a sealing ball, a sliding sleeve, a packer, a bridge plug, a cement sleeve, a wiper, a pipe plug, a ICD plug, an AICD plug, or a similar wellbore isolation device.

In some embodiments, multiple wellbore isolation devices, such as but not limited to, multiple frac plugs, are deployed by the tool string 116 to isolate each of the first, second, and third zones 112*a*, 112*b*, and 112*c* from other portions of the wellbore 114.

Figure 2:
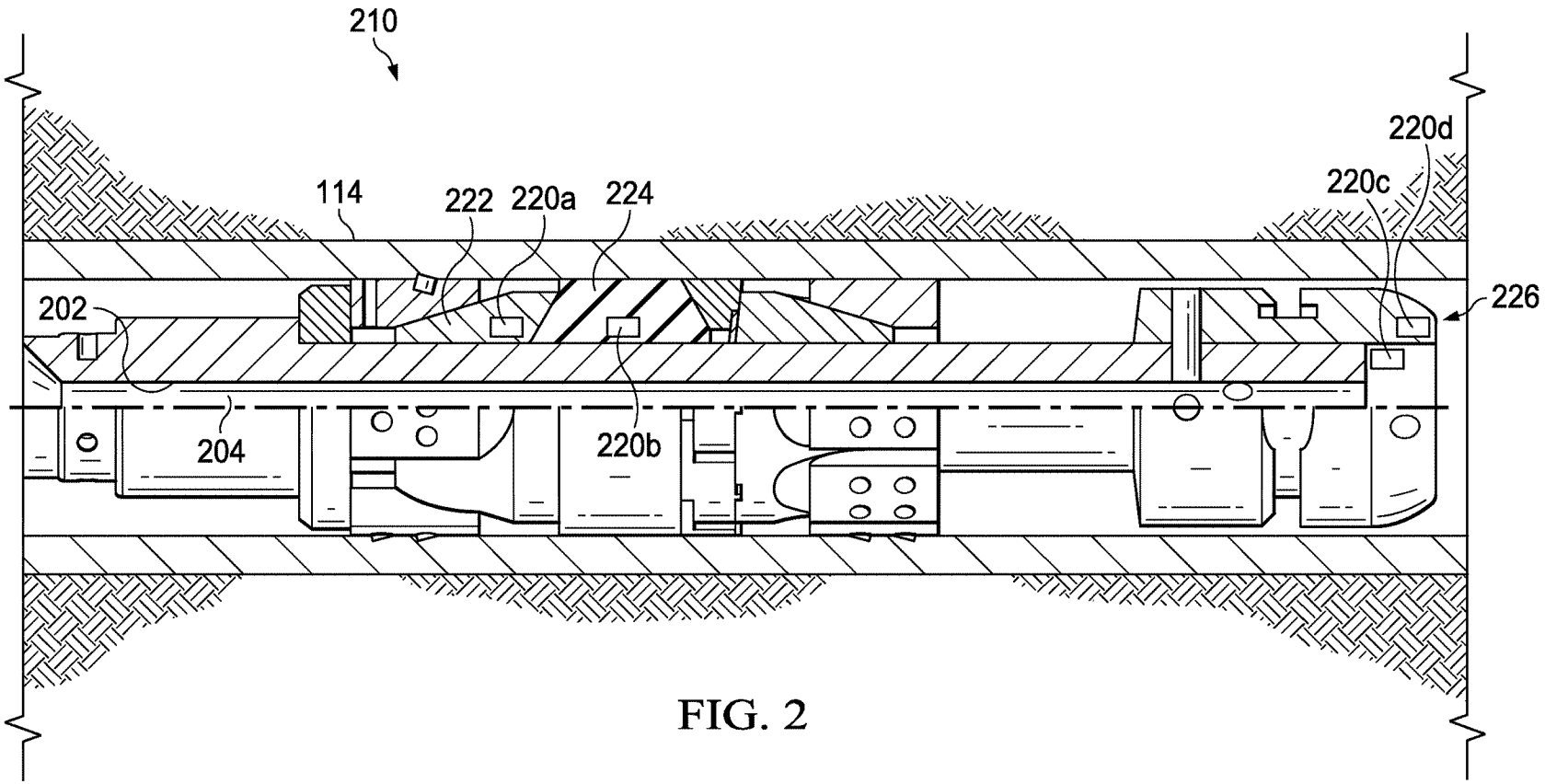
FIG. 2 is a side view of an example of a frac plug that may function as a wellbore isolation device, disposed within the wellbore of FIG. 1.

FIG. 2 is a side view of an example of a frac plug 210, which is analogous to the frac plugs (wellbore isolation devices 110*a*, 110*b*, 110*c*) disposed within the wellbore 114 of FIG. 1. The frac plug 210 may be manufactured using a variety of dissolvable materials, composites, and packer elements. In some embodiments, the frac plug 210 includes a mandrel 202 that defines a flow passage 204 and a sealing ball [not shown]. In one of such embodiments, the frac plug 210 has an opening position where fluids such as the pressurized wellbore fluid, may be displaced through the flow passage 204 and a closed position where the flow passage 204 is sealed by the sealing ball. In another one of such embodiments [not shown], a sealing ball of the frac plug 210 is operable to expand to engage the wellbore 114 to create an isolation zone at the location of the frac plug 210. In other embodiments, the frac plug 210 includes a solid interior and an expandable external sealing element operable to expand to engage the wall of the wellbore 114 to create an isolation at the location of the frac plug 210. The frac plug 210 may be compatible with a variety of tools, including but not limited to electric wireline setting tools, slickline setting tools, and hydraulic setting tools.

In some embodiments, the frac plug 210 includes a first identification tag 220*a*, a second identification tag 220*b*, a third identification tag 220*c*, and a fourth identification tag 220*d*. The first identification tag 220*a* is disposed in a wedge portion 222 of the frac plug 210. The second identification tag 220*b* is enclosed within a packer element 224 that is substantially insoluble when exposed to a wellbore fluid. The third identification tag 220*c* is placed on an identification plate of the frac plug 210 that includes a serial number of the frac plug 210. The fourth identification tag 220*d* is disposed within a mule shoe portion 226 of the frac plug 210.

Each of the identification tags 220 may include identifying information of the frac plug 210 (e.g., a serial number) and may also or alternatively include identification information of the component of the frac plug 210 in which the identification tag 220 is initially placed.

In some embodiments, the frac plug 210 is partially or completely manufactured from materials that are dissolvable when in contact with a solvent fluid, which may be the wellbore fluid. In such embodiments, the first, second, third, and fourth identification tags 220*a*, 220*b*, 220*c*, and 220*d* are released from the frac plug 210 following dissolution of at least a part of the frac plug 210 or, more particularly, the component of the frac plug to which the identification tag is affixed.

The frac plug 210 may be disposed at the zone boundary of the first, second, or third zone 112*a*, 112*b*, or 112*c* of the target region 150 illustrated in FIG. 1 to isolate the respective zone 112*a*, 112*b*, or 112*c* from other portions of the wellbore 114 during certain stages of hydraulic fracking. The frac plug 210, however, would eventually be removed or dislodged to allow retrieval of the wellbore fluid and to allow continued wellbore preparation or to allow hydrocarbon resources to flow from the fractures, through the wellbore 114, and to the surface 108. The wellbore fluid and the hydrocarbon resources previously isolated by the frac plug 210 can flow towards the surface 108 following dissolution of at least a portion of the frac plug 210.

Identification tags 220*a*, 220*b*, 220*c*, and 220*d* are used to identify of the frac plug 210 after the frac plug has been partially or completely dissolved. In particular, each of the identification tags 220*a*, 220*b*, 220*c*, and 220*d* provides a tool for identifying the frac plug 210 and components thereof. In such embodiments, the identification tags 220*a*, 220*b*, 220*c*, 220*d* are formed from materials that are substantially insoluble when exposed to the wellbore fluid or the hydrocarbon resources and thereby survive dissolution of the frac plug 210. As referenced herein, a "substantially insoluble" material is a material that does not degrade or dissolve when exposed to the wellbore fluid or to the hydrocarbon resource for a period of time greater than or equal to a period for drilling, completing, or stimulating the well 102. Examples of materials used to form the identification tags 220*a*, 220*b*, 220*c*, and 220*d* include, but are not limited to, metal alloys and composite materials that are substantially insoluble when exposed to the wellbore fluid or the hydrocarbon resources.

In other embodiments, the identification tags 220*a*, 220*b*, 220*c*, and 220*d* are formed from biodegradable materials, such as, but not limited to, thiol polymer, polyurethane, silk, PGA, PLA, ethylene propylene diene monomer (EPDM), nylon, etc. In one of such embodiments, the first identification tag 220*a* is dissolvable when exposed to the wellbore fluid and dissolves at a rate that is slower than the dissolution rate of the frac plug 210. This configuration allows detection or recovery of the first identification tag 220*a* following dissolution of a portion of the frac plug 210, but the delayed dissolution of the identification tag 220 may result in the fluid being reusable without filtering of the identification tags 220.

In another one of such embodiments, the second identification tag 220*b* is dissolvable when exposed to hydrocarbon resources but is not dissolvable when exposed to the wellbore fluid that does not include hydrocarbons. In this embodiment, dissolution of the second identification tag 220*b* would not begin until the second identification tag 220*b* has been released from the frac plug 210.

In further embodiments, the identification tags 220*a*, 220*b*, 220*c*, and 220*d* release chemical agents such as, but not limited to dyes and chemical tracers into the wellbore fluid after the identification tags 220*a*, 220*b*, 220*c*, and 220*d* are exposed to the wellbore fluid. In one of such embodiments, each of the identification tags 220*a*, 220*b*, 220*c*, and 220*d* includes a specific dye or chemical tracer. The inline detector 124*a* includes sensors operable to detect the released dyes or chemical tracers and determine which the identification tag 220*a*, 220*b*, 220*c*, and/or 220*d* has been exposed to the wellbore fluid.

In some embodiments, the identification tags 220*a*, 220*b*, 220*c*, and 220*d* are encapsulated within another material. The material may be disposed within the frac plug 210, or disposed proximate to a dissolvable portion of the frac plug 210. The material is releasable into the wellbore 114 following dissolution of a portion of the frac plug. 210. In one of such embodiments, the first identification tag 220*a* is a chemical tracer, and is encapsulated within a material that is substantially insoluble when exposed to the wellbore fluid. The material and the first identification tag 220*a* are disposed proximate to the dissolvable portion of the frac plug 210 and are released into the wellbore 114 upon dissolution of the dissolvable portion of the frac plug 210.

In one of such embodiments, the first identification tag 220*a* includes a RFID chip that includes an identification of the frac plug 210 stored on the chip and is operable to transmit the identification of the frac plug 210. Further, the second identification tag 220*b* is enclosed in a packer element that is substantially insoluble when exposed to the wellbore fluid and includes a NFC component operable to transmit the identification of the frac plug 210. In another one of such embodiments, the first identification tag 220*a* and the second identification tag 220*b* include identifications of different components of the frac plug 210 and are disposed within different portions of the frac plug 210 that have different solubility. For example, the first identification tag 220*a* is disposed within the wedge portion 222 of the frac plug 210 and may be released from the frac plug 210 after a first period of time. The first identification tag 220*a* includes not only the identification of the frac plug 210 but also the identification of the wedge portion 222 of the frac plug 210. An operator, upon receiving signals from the RFID chip of the first identification 210*a*, would not only identify the frac plug 210, but would also identify that the wedge portion 222 of the frac plug 210 has partially and/or completely dissolved.

The second identification tag 220*b* provides identification of the frac plug 210 and an identification of a second component of the frac plug 210. The second identification tag 220*b* and the packer element 224 which encloses the second identification tag 220*b*, are disposed within a portion of the frac plug 210 constructed from a material that dissolves at a slower rate than the dissolution rate of the wedge portion 222. As such, if the operator obtains a signal from the first identification tag 210*a* but not from the second identification tag 220*b*, the operator would be able to deduce that the second component of the frac plug 210 has not yet dissolved. Conversely, if the operator obtains a signal from the second identification tag 210*b*, but not from the first identification tag 210*a*, the operator would be able to deduce that both the first and the second components of the frac plug have partially dissolved. Based on such information, the operator may make additional deductions such as, but not limited to, the overall condition of the frac plug 210, the wellbore 114 proximate to the location of the frac plug 210, and fluid resource flow rate proximate to the location of the frac plug 210.

The distinct components of the frac plug 210 (e.g., the mandrel and sealing element) may form distinct dissolvable portions. As such, the frac plug 210 may include a first dissolvable portion having material properties that cause the first dissolvable portion to dissolve after being exposed to a wellbore fluid for a first period of time. A first identification tag is disposed within the wellbore isolation device. The first identification tag 220*a* remains within the frac plug 210 while the first dissolvable portion is intact. Similarly, the frac plug 210 may include a second dissolvable portion having the same or different material properties as compared to the first dissolvable portion. Where the materials are different, the second dissolvable portion may dissolve after being exposed to the wellbore fluid for a second period of time that is shorter or longer than the first period of time. Like the first identification tag 220*a*, the second identification tag 220*b* remains disposed within the wellbore isolation device while the second dissolvable portion is intact. Similarly, the second identification tag 220*b* may be released following dissolution of the second dissolvable portion.

In accordance with the foregoing embodiment, the first and second the identification tags 220*a* and 220*b* provide identification of different components of the frac plug 210. In such embodiments, releasing the first and second identification tags 220*a* and 220*b* at different times provides information regarding the condition of the different components of the frac plug 210.

In some embodiments, the first and second identification tags 220*a* and 220*b* are enclosed in materials that are substantially insoluble in the wellbore fluid. In such embodiments, the materials are released from the frac plug 210 and are carried from the location of the frac plug 210, along the flow path, and into the container 130 upon dissolution. In some embodiments, the substantially insoluble material has a lower specific gravity than the wellbore fluid in order to aid the flowback of the identification tag. In other embodiments, the substantially insoluble material has an increased flow resistance and will more easily be carried in the produced fluid.

In one of such embodiments, a segment of the wedge portion 222 of the frac plug 210 is formed from materials that are substantially insoluble in the wellbore fluid. A recess is formed within the segment of the wedge portion 222 and the first identification tag 220*a* is disposed within the recess of the wedge portion 222. In another one of such embodiments, a segment of the mule shoe portion 226 of the frac plug 210 is formed from materials that are substantially insoluble in the wellbore fluid. A recess is formed within the a segment of the mule shoe portion 226 of the frac plug 210 and the fourth identification tag 220*d* is disposed within proximity of the insoluble segment of the mule shoe portion 226. The fourth identification tag 220*d* flows into the recess of the insoluble segment of the mule shoe portion 226 after dissolution of the dissolvable portions of the frac plug 210 proximate to the fourth identification tag 220*d*, and the insoluble segment of the mule shoe portion 226 flows along the flow path to the surface.

In further embodiments, segments of both the wedge portion and the mule shoe portions of the frac plug 210 are formed to enclose the first and fourth identification tags 220*a* and 220*d*, respectively, within the recesses of the two segments. Insoluble segments of both the wedge portion and the mule shoe portion are releasable from the frac plug 210 upon dissolution of dissolvable portions of the frac plug 210 proximate to the respective portion.

Figure 3:
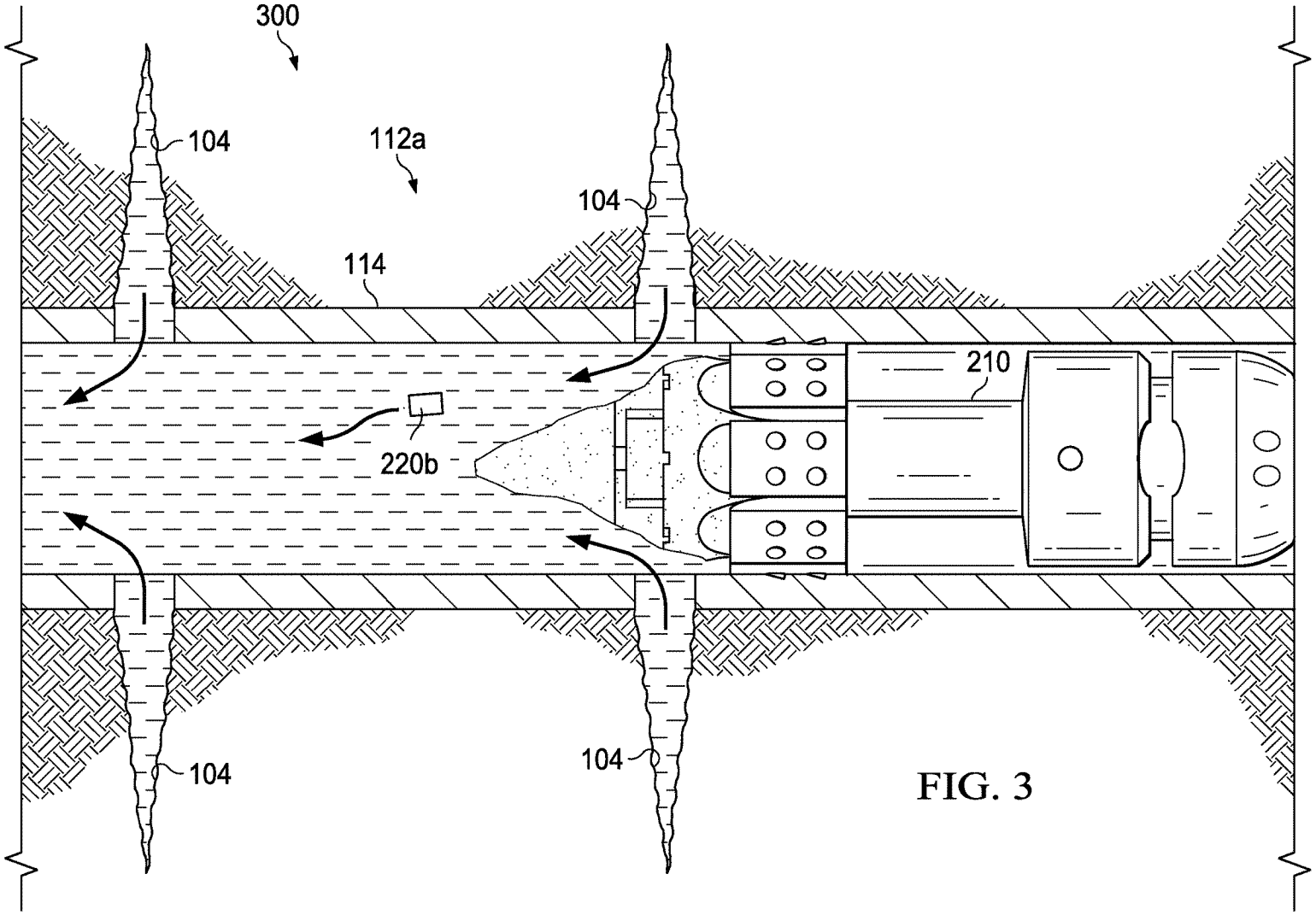
FIG. 3 is a schematic diagram illustrating an identification tag of the frac plug of FIG. 2 after the frac plug is partially dissolved.

FIG. 3 is a schematic diagram illustrating the second identification tag 220*b* of the frac plug 210 of FIG. 2, after the frac plug 210 is partially dissolved. As illustrated in FIG. 3, the second identification tag 220*b* has been dislodged from the partially dissolved frac plug 210. The second identification tag 220*b* follows a return fluid flow path through the first zone 112*a* of the wellbore 114 towards the surface 108.

As the second identification tag 220*b* travels along the return fluid flow path towards the surface 108, the second identification may pass by detectors such as inline detector 124*a* or other components disposed at different depths along the flow path and operable to communicate with the second identification tag 220*b*. In some embodiments, the inline detector 124*a* is operable to transmit a request for the second identification tag 220*b* to provide the identification of the frac plug 210*b*. The inline detector 124*a* (shown in FIG. 1.), upon detection of the identification of the frac plug 210, may also transmit information relating to the identification tag to the controllers 118 at the surface 108.

By obtaining the identification of the frac plug 210 at the depth of the inline detector 124*a*, the identity of the frac plug 210 is available before the second identification device 220*b* reaches the surface 108. Further, the identification of the frac plug 210 may also be obtained in case the second identification tag 220*b* becomes damaged or becomes inoperable during the remainder of its travel to the surface 108.

Additional detectors may be placed along the return fluid flow path to facilitate communication with the second identification tag 220*b*. In the embodiment illustrated in FIG. 1, the collection container detector 124*b* is coupled to the outlet conduit 128 along the return fluid flow path. The collection container detector 124*b*, similar to the inline detector 124*a*, is also operable to communicate with the second identification tag 220*b* to obtain the identification of the frac plug.

The return fluid flow path terminates in the container 130 at the surface 108. The container 130 includes storage areas where fluids, such as the pressurized wellbore fluid, may be safely stored. In one embodiment, the container 130 includes a collection basket for retrieving the second identification tag 220*b*. In another embodiment, the container 130 includes a net or sieve for retrieving the second identification tag 220*b*. In further embodiments, the container 130 includes one or more mechanical or electrical assemblies for retrieving the second identification tag 220*b*. In further embodiments, the controllers 118 may establish communication with the second identification tag 220*b* to directly obtain the identification of the frac plug 210. Alternatively, an operator may also manually retrieve the second identification tag 220*b* from the container 130.

Figure 4:
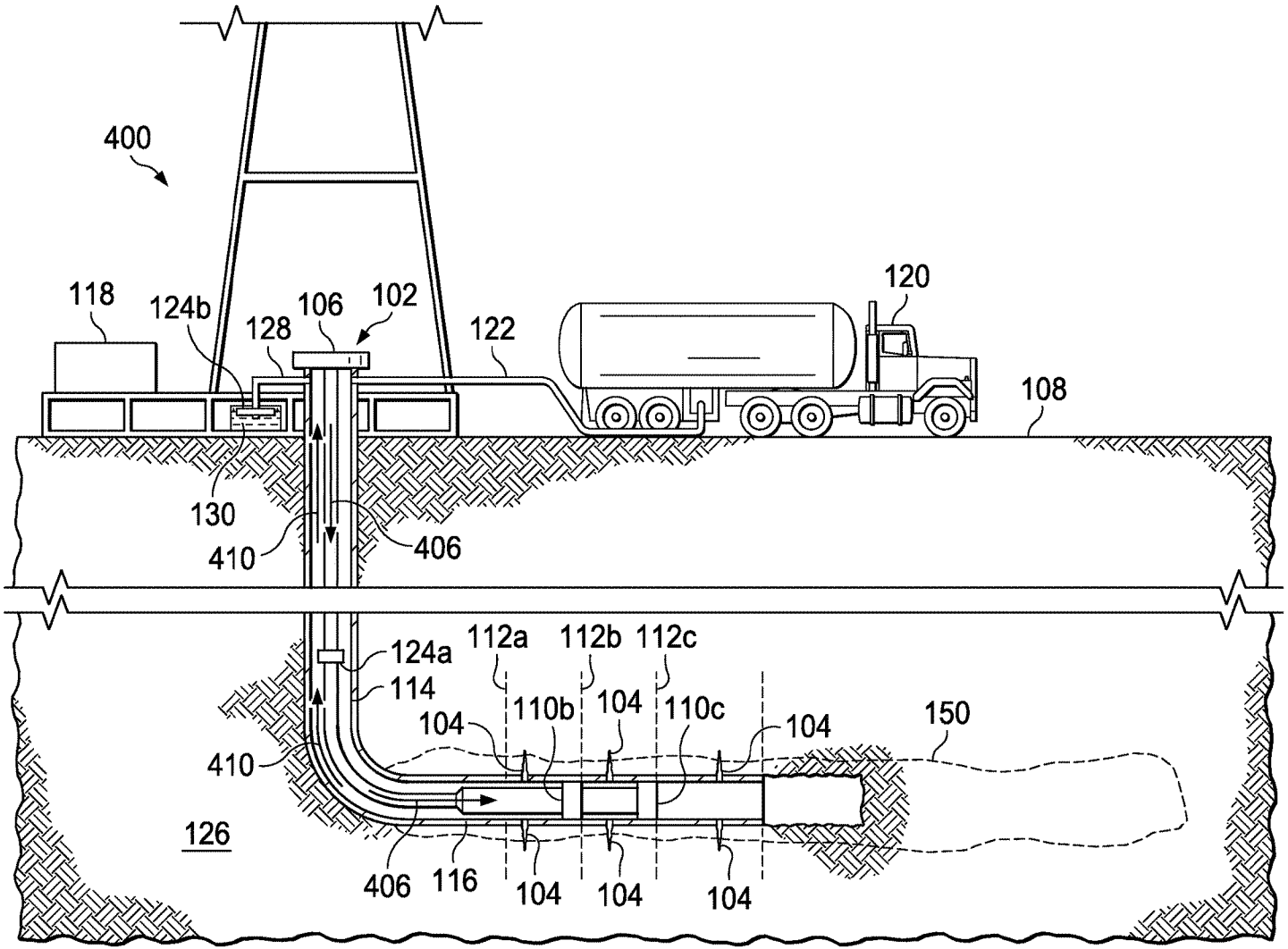
FIG. 4 is a schematic diagram of a downhole device tracking system in the hydraulic fracking environment of FIG. 1 that includes controllers and detectors operable to detect the identification tag of the frac plug.

FIG. 4 is a schematic diagram of a downhole device tracking system 400 operable in the hydraulic fracking environment 100 of FIG. 1. The downhole device tracking system 400 includes a tool string 116 defining a conduit or fluid flow path into the well. The conduit of the tool string 116 and the inlet conduit 122 together form a fluid flow path for pressurized wellbore fluid to flow from the wellbore fluid source 120 to the target zone 150. As illustrated in FIG. 4, the pressurized wellbore fluid flows down the hollow interior of the perforation tool string 116 in along the inlet fluid flow path 406 into the perforations 104 in the first zone 112*a*.

As illustrated in FIG. 4, the second and third zones 112*b* and 112*c* of the target region 150 are isolated from the remainder of the wellbore 114 by wellbore isolation device 110*b*. As such, once a portion of the first zone has been filled by the pressurized wellbore fluid, the wellbore fluid begins to flow towards the surface 108 along an annulus region, which together with the outlet conduit 128, form a return fluid flow path 410. The return fluid flow path terminates in the container 130, which contains at least one compartment to collect the wellbore fluid. Further, once the wellbore isolation devices 110*b* and 110*c* dissolve due to contact with the pressurized wellbore fluid, pressurized wellbore fluid previously isolated within the second and the third zones may also flow through via the return fluid flow path 410 to the surface 108. A pump (not shown) may be connected to the outlet conduit 128 to facilitate flow of the pressurized wellbore fluid via the return fluid flow path into the container 130.

In some embodiments, hydrocarbon resource deposits trapped in the formation 126 are released into the perforations 104 in the first, second, and third zones 112*a*, 112*b*, and 112*c*. The hydrocarbon resource deposits also flow from the target zone 150, along the return fluid flow path where they may be diverted through the container 130 prior to collection for processing. A pump may be coupled to the outlet conduit 128 to facilitate flow of the fluidly hydrocarbon resource deposits via the return fluid flow path into the container 130.

In some embodiments, the pressurized wellbore fluid and/or the released fluidly hydrocarbon resources transport identification tags of the first, second, and third wellbore isolation device 110*a*, 110*b*, and 110*c* from the target zone 150, along the return fluid flow path 410, and into the container 130. In one of such embodiments, the container 130 includes a compartment for capturing or reading the identification tags. In another one of such embodiments, a detector operable to detect the identification tags is disposed within the compartment of the container 130 to communicate with the identification tags to obtain identifications of the corresponding wellbore isolation devices 110*a*, 110*b*, and 110*c*.

In some embodiments, the system 400 includes one or more detectors, such as the inline detector 124*a* and the collection container detector 124*b* to monitor fluid circulation along the fluid flow path 406 and the return fluid flow path 410. In one of such embodiments, the inline detector 124*a* and the collection container detector 124*b* are operable to monitor fluid flow rate along the fluid flow path 406 and the return fluid flow path 410 by determining the rate of travel of the identification tags. In some embodiments, the inline detector 124*a* and the collection container detector 124*b* are operable to detect presence of identification tags along the return fluid flow path 410. In one of such embodiments, the inline detector 124*a* and the collection container detector 124*b* may be operable to communicate with the identification tags along the return fluid flow path 410 to obtain identifications of the corresponding wellbore isolation devices. In one of such embodiments, the inline detector 124*a* and the collection container detector 124*b* may further be operable to obtain data indicative of the conditions of the corresponding wellbore isolation devices and the condition of the wellbore proximate to the location of the corresponding wellbore isolation devices.

Figure 5:
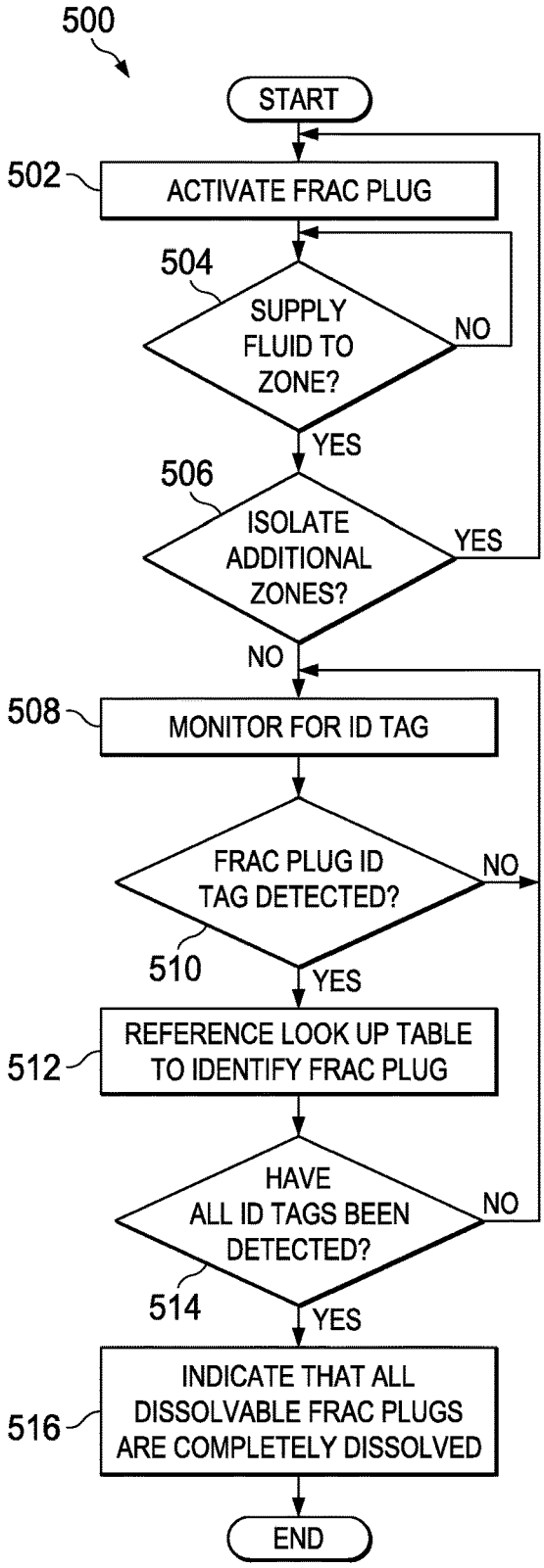
FIG. 5 is a flow chart illustrating a process for determining conditions of frac plugs disposed in a target region of a hydraulic fracking environment.

FIG. 5 is a flow chart illustrating a process 500 for determining conditions of frac plugs disposed in a target region of a hydraulic fracking environment. Although the operations in the process 500 describe are shown in a particular order, certain operations may be performed in different orders or at the same time where feasible.

At step 502, a dissolvable frac plug is activated at a boundary of a zone to isolate the zone from other zones of the target region. At step 504, pressurized wellbore fluid is supplied to the zone. At step 506, if more zones should be isolated, then the process proceeds to step 502, and another dissolvable frac plug is activated to isolate an additional zone. If all of the zones have been isolated, the process proceeds to step 508, and a detector is operated to monitor for indications of identification tags of the activated frac plugs.

At step 510, if the detector detects an identification tag of one of the dissolvable frac plugs, the process proceeds to step 512 and a look-up table is referenced to identify the frac plug associated with the detected identification tag. At step 514, the detector, or a controller determines whether all of the identification tags of the dissolvable frac plugs have been detected. The process proceeds to step 508 if not all of the identification tags have been detected, and the detector continues to monitor for identification tags. Alternatively, if all of the identification tags of the dissolvable frac plugs have been detected, the process proceeds to step 516, and an indication that all of the dissolvable frac plugs are completely dissolved is provided to an operator.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. For instance, although the flowcharts depict a serial process, some of the steps/processes may be performed in parallel or out of sequence, or combined into a single step/process. The scope of the claims is intended to broadly cover the disclosed embodiments and any such modification.

As used herein, the singular forms "a", "an" and "the" are intended to include the plural forms as well, unless the context clearly indicates otherwise. It will be further understood that the terms "comprise" and/or "comprising," when used in this specification and/or the claims, specify the presence of stated features, steps, operations, elements, and/or components, but do not preclude the presence or addition of one or more other features, steps, operations, elements, components, and/or groups thereof. In addition, the steps and components described in the above embodiments and figures are merely illustrative and do not imply that any particular step or component is a requirement of a claimed embodiment.

The present disclosure may also be understood as including at least the following clauses:

Clause 1: A wellbore isolation device comprising: a first dissolvable component; and a first identification tag identifying the wellbore isolation apparatus and disposed at a first location within the wellbore isolation device, wherein the first identification tag is releasable from the wellbore isolation device upon dissolution of the first dissolvable component.

Clause 2: The wellbore isolation device of clause 1, further comprising a substantially insoluble component enclosing the identification tag, the substantially insoluble component being constructed from a material that is not dissolvable when exposed to a wellbore fluid, the substantially insoluble component being releasable from the wellbore isolation device upon dissolution of the first dissolvable component.

Clause 3: The wellbore isolation device of either of clauses 1 or 2, further comprising a second dissolvable component and a second identification tag coupled to the wellbore isolation device at a second location, wherein the first dissolvable component is configured to dissolve after being exposed to a wellbore fluid for a first time period; wherein the second dissolvable component is configured to dissolve after being exposed to the wellbore fluid for a second time period, the second time period being longer than the first time period; and wherein the second identification tag is releasable upon dissolution of the second dissolvable component.

Clause 4: The wellbore isolation device of any of clause 3, wherein the first identification tag identifies the first dissolvable component, and wherein the second identification tag identifies the second dissolvable component.

Clause 5: The wellbore isolation device of any of clauses 1-4, wherein the first component comprises a material selected from the group consisting of a magnesium alloy, an aluminum alloy, a polyglycolic acid (PGA), a polylatic acid (PLA), thiol, and polyurethane.

Clause 6: The wellbore isolation device of any of clauses 1-5, wherein the wellbore fluid comprises a solvent selected from the group consisting of water, a hydrocarbon, alcohol, acetone, and propanediol.

Clause 7: The wellbore isolation device of any of clauses 1-6, wherein the identification tag comprises a radio-frequency identification (RFID) chip.

Clause 8: The wellbore isolation device of any of clauses 1-6, wherein the identification tag comprises a near field communication transmitter.

Clause 9: The wellbore isolation device of any of clauses 1-8, wherein the identification tag comprises chemical tracers, wherein the chemical tracers are releasable from the identification tag upon dissolution of the first dissolvable component, and wherein the chemical tracers are detectable by a detector when released into the wellbore fluid.

Clause 10: The wellbore isolation device of any of clauses 1-9, wherein identification tag comprises a biodegradable material selected from the group consisting of a thiol polymer, polyurethane, silk, PGA, PLA, ethylene propylene diene monomer (EPDM).

Clause 11: The wellbore isolation device of any of clauses 1-10, wherein the wellbore isolation device is a frac plug.

Clause 12: A method for forming a wellbore isolation device, the method comprising: forming a first dissolvable portion of the wellbore isolation device; and disposing a first identification tag at a first location within the wellbore isolation device, the first identification tag identifying the wellbore isolation device, wherein the first dissolvable portion is configured to dissolve after being exposed to a wellbore fluid for a first time period, and wherein the first identification tag is releasable from the wellbore isolation device upon dissolution of the first dissolvable portion.

Clause 13: The method of clause 12, further comprising: forming a second dissolvable portion of the wellbore isolation device; and disposing a second identification tag coupled to the wellbore isolation device at a second location, wherein the first dissolvable portion is configured to dissolve after being exposed to a wellbore fluid for a first time period, wherein the second dissolvable portion is configured to dissolve after being exposed to the wellbore fluid for a second time period, the second time period being longer than the first time period, and wherein the second identification tag is releasable upon dissolution of the second dissolvable portion.

Clause 14: The method of clause 12, further comprising: forming a second dissolvable portion of the wellbore isolation device; and disposing a second identification tag coupled to the wellbore isolation device at a second location, wherein the first identification tag identifies a first component of the wellbore isolation device, wherein the second identification tag identifies a second component of the wellbore isolation device, and wherein the second identification tag is releasable upon dissolution of the second dissolvable portion.

Clause 15: The method of any of clauses 12-14, further comprising enclosing the first identification tag within a substantially insoluble material, wherein the substantially insoluble material has a lower specific gravity than the wellbore fluid.

Clause 16: The method of any of clauses 12-15, further comprising enclosing the first identification tag within a substantially insoluble material, wherein the substantially insoluble material has a high flow resistance.

Clause 17: The method clause of any of clauses 12-16, further comprising enclosing the first identification tag within a portion of the wellbore isolation device, the portion being not dissolvable when exposed to a wellbore fluid.

Clause 18: A downhole, device-tracking system comprising: a wellbore isolation device having a first identification tag and a dissolvable component, wherein the first identification tag is operable to travel along a fluid flow path toward the surface of a well upon dissolution of the dissolvable component; and a detector disposed along the fluid flow path, wherein the detector is operable to detect the first identification tag when the identification tag is proximate the detector.

Clause 19: The system of clause 18 further comprising a compartment for receiving the first identification tag from the fluid flow path following dissolution of the dissolvable portion, wherein the detector is disposed proximate the compartment, and wherein the detector is operable to obtain, based on the identification tag, identification information corresponding to the wellbore isolation device.

Clause 20: The system of clause 18 or 19, wherein the detector is positioned downhole and communicatively coupled to a surface controller, and wherein the detector is operable to transmit identification information corresponding to the wellbore isolation device to the surface controller.

What is claimed is:

1. A wellbore isolation device comprising:

a first dissolvable component, wherein the first dissolvable component comprises a material selected from the group consisting of a polyglycolic acid (PGA), a polylatic acid (PLA), thiol, and polyurethane; and a first identification tag identifying the wellbore isolation device and disposed at a first location within the wellbore isolation device, wherein the first identification tag is releasable from the wellbore isolation device upon dissolution of the first dissolvable component.

2. The wellbore isolation device of claim 1, further comprising a substantially insoluble component enclosing the identification tag, the substantially insoluble component being constructed from a material that is not dissolvable when exposed to a wellbore fluid, the substantially insoluble component being releasable from the wellbore isolation device upon dissolution of the first dissolvable component.

3. The wellbore isolation device of claim 1, further comprising a second dissolvable component and a second identification tag coupled to the wellbore isolation device at a second location, wherein the first dissolvable component is configured to dissolve after being exposed to a wellbore fluid for a first time period;

wherein the second dissolvable component is configured to dissolve after being exposed to the wellbore fluid for a second time period, the second time period being longer than the first time period; and wherein the second identification tag is releasable upon dissolution of the second dissolvable component.

4. The wellbore isolation device of claim 3, wherein the first identification tag identifies the first dissolvable component, and wherein the second identification tag identifies the second dissolvable component.

5. The wellbore isolation device of claim 1, wherein a wellbore fluid comprises a solvent selected from the group consisting of water, a hydrocarbon, alcohol, acetone, and propanediol.

6. The wellbore isolation device of claim 1, wherein the identification tag comprises a radio-frequency identification (RFID) chip.

7. The wellbore isolation device of claim 1, wherein the identification tag comprises a near field communication transmitter.

8. The wellbore isolation device of claim 1, wherein the identification tag comprises chemical tracers, wherein the chemical tracers are releasable from the identification tag upon dissolution of the first dissolvable component, and wherein the chemical tracers are detectable by a detector when released into the wellbore fluid.

9. The wellbore isolation device of claim 1, wherein identification tag comprises a biodegradable material selected from the group consisting of a thiol polymer, polyurethane, silk, PGA, PLA, ethylene propylene diene monomer (EPDM).

10. The wellbore isolation device of claim 1, wherein the wellbore isolation device is a frac plug.

11. A method for forming a wellbore isolation device, the method comprising:

forming a first dissolvable portion of the wellbore isolation device wherein the first dissolvable portion comprises a material selected from the group consisting of a polyglycolic acid (PGA), a polylatic acid (PLA), thiol, and polyurethane; and disposing a first identification tag at a first location within the wellbore isolation device, the first identification tag identifying the wellbore isolation device, wherein the first dissolvable portion is configured to dissolve after being exposed to a wellbore fluid for a first time period, and wherein the first identification tag is releasable from the wellbore isolation device upon dissolution of the first dissolvable portion.

12. The method of claim 11, further comprising:

forming a second dissolvable portion of the wellbore isolation device; and disposing a second identification tag coupled to the wellbore isolation device at a second location, wherein the first dissolvable portion is configured to dissolve after being exposed to a wellbore fluid for a first time period, wherein the second dissolvable portion is configured to dissolve after being exposed to the wellbore fluid for a second time period, the second time period being longer than the first time period, and wherein the second identification tag is releasable upon dissolution of the second dissolvable portion.

13. The method of claim 11, further comprising:

forming a second dissolvable portion of the wellbore isolation device; and disposing a second identification tag coupled to the wellbore isolation device at a second location, wherein the first identification tag identifies a first component of the wellbore isolation device, wherein the second identification tag identifies a second component of the wellbore isolation device, and wherein the second identification tag is releasable upon dissolution of the second dissolvable portion.

14. The method of claim 11, further comprising enclosing the first identification tag within a substantially insoluble material, wherein the substantially insoluble material has a lower specific gravity than the wellbore fluid.

15. The method of claim 11, further comprising enclosing the first identification tag within a substantially insoluble material, wherein the substantially insoluble material has a high flow resistance.

16. The method claim of 12, further comprising enclosing the first identification tag within a portion of the wellbore isolation device, the portion being not dissolvable when exposed to a wellbore fluid.

17. A downhole, device-tracking system comprising:

a wellbore isolation device comprising a first identification tag, a first dissolvable component, wherein the first identification tag is operable to travel along a fluid flow path toward the surface of a well upon dissolution of the dissolvable component, wherein the first dissolvable component comprises a material selected from the group consisting of a polyglycolic acid (PGA), a polylatic acid (PLA), thiol, and polyurethane; and a detector disposed along the fluid flow path, wherein the detector is operable to detect the first identification tag when the identification tag is proximate the detector.

18. The system of claim 17 further comprising a compartment for receiving the first identification tag from the fluid flow path following dissolution of the dissolvable component, wherein the detector is disposed proximate the compartment, and wherein the detector is operable to obtain, based on the identification tag, identification information corresponding to the wellbore isolation device.

19. The system of claim 17, wherein the detector is positioned downhole and communicatively coupled to a surface controller, and wherein the detector is operable to transmit identification information corresponding to the wellbore isolation device to the surface controller.

* * * * *